US011281248B2

(12) United States Patent
Wu et al.

(10) Patent No.: US 11,281,248 B2
(45) Date of Patent: Mar. 22, 2022

(54) AUDIO MICROPHONE DETECTION USING AUTO-TRACKING CURRENT COMPARATOR

(71) Applicant: Nuvoton Technology Corporation, Hsinchu (TW)

(72) Inventors: Chang-Xian Wu, San Jose, CA (US); Bal S. Sandhu, Fremont, CA (US)

(73) Assignee: NUVOTON TECHNOLOGY CORPORATION, Hsinchu (TW)

( * ) Notice: Subject to any disclaimer, the term of this patent is extended or adjusted under 35 U.S.C. 154(b) by 265 days.

(21) Appl. No.: 16/789,352

(22) Filed: Feb. 12, 2020

(65) Prior Publication Data

US 2021/0247790 A1 Aug. 12, 2021

(51) Int. Cl.

| | |
|---|---|
| ***G05F 1/56*** | (2006.01) |
| ***G05F 1/575*** | (2006.01) |
| ***G05F 1/59*** | (2006.01) |
| ***G05F 1/595*** | (2006.01) |
| ***H04R 3/00*** | (2006.01) |
| ***H04R 29/00*** | (2006.01) |

(52) U.S. Cl.

CPC ..... *G05F 1/575* (2013.01); *H04R 3/00* (2013.01)

(58) Field of Classification Search

CPC ... G05F 1/56; G05F 1/575; G05F 1/59; G05F 1/595; H04R 3/00; H04R 29/004

See application file for complete search history.

(56) References Cited

U.S. PATENT DOCUMENTS 7,576,524 B2 * 8/2009 Ohoka ..... G05F 1/573 323/275
8,289,009 B1 * 10/2012 Strik ..... G05F 1/575 323/272
8,928,296 B2 * 1/2015 Iriarte ..... G05F 3/262 323/280
2008/0007231 A1 * 1/2008 Maige ..... G05F 1/575 323/225
2012/0223688 A1 * 9/2012 Iriarte ..... G05F 1/56 323/280
2015/0212530 A1 * 7/2015 Forejtek ..... G05F 1/56 323/280
2019/0011944 A1 * 1/2019 Ono ..... G05F 1/59
2021/0072781 A1 * 3/2021 Wu ..... G05F 3/30
2021/0089068 A1 * 3/2021 Manohar ..... G05F 1/575

FOREIGN PATENT DOCUMENTS

JP 2020030737 A * 2/2020 ..... G05F 1/575

* cited by examiner

*Primary Examiner* — Sisay G Tiku

(74) *Attorney, Agent, or Firm* — Kilpatrick Townsend & Stockton LLP

(57) ABSTRACT

An integrated circuit includes a current detection circuit configured for coupling to an output terminal of a voltage regulator, the output terminal providing a total current that is divided into a load current to a load device and a feedback current for providing a feedback signal to the voltage regulator. The current detection circuit includes a current sampling circuit and a current comparator circuit. The current sampling circuit provides a first current that is proportional to the total current, a second current that is proportional to the feedback current, and a third current that is proportional to the load current. The current comparator circuit is configured to compare the third current with a threshold current, and output a detection signal that indicates whether the third current matches the threshold current, thereby indicating a target load device is detected.

20 Claims, 5 Drawing Sheets

AUDIO MICROPHONE DETECTION USING AUTO-TRACKING CURRENT COMPARATOR

BACKGROUND OF THE INVENTION

This invention relates to electronic circuits. In particular, embodiments of the invention are directed to load device detection circuits for a voltage regulator. Some embodiments described herein are applied to a microphone detection circuit for an audio system. However, the circuit and methods described here can be used in applications which involve the accurate determination of a load current for a voltage regulator.

In an audio system, an integrated circuit is often used to receive audio signals from a microphone and provide output signals to drive speakers. It is desirable for the integrated circuit to be able to function with different microphones, which may have different voltage and current characteristics. Therefore, such an integrated circuit often includes a microphone detection circuit to detect when a microphone is connected to the system and determine what kind of microphone is connected to the system.

Conventional solutions to microphone detection often suffer from numerous shortcomings. These shortcomings can include complicated circuits, large chip area, and insufficient accuracy. These shortcomings are described in more detail, and improved methods and circuits are provided below.

BRIEF SUMMARY OF THE INVENTION

An integrated circuit for an audio system often provides a power supply to a microphone. It is highly desirable to have the capability to determine whether a microphone is connected and what type of microphone is connected to the audio system. Some conventional circuits require an extra pin and complicated voltage comparators for this determination. Other conventional circuits use a current comparator, but cannot determine the load current provided to the microphone to determine the type of microphone connected to the system.

Therefore, embodiments of the present invention provide methods and apparatus with a current tracking system to monitor the load current on the microphone power supply pin and reproduce the same voltage as the output transistor in the voltage regulator. In addition, the load current can be more accurately determined by removing the error caused by separating the load current and an internal current at the microphone power supply terminal. In embodiments of the invention, an extra microphone detection pin is not required, resulting in saving the chip area. In addition, low-offset voltage comparators are not required. Accordingly, a more cost-effective microphone detection can be provided.

According to some embodiments of the present invention, an integrated circuit for audio microphone detection includes a voltage regulator configured to provide a regulated output voltage at an output terminal for coupling to a load device. The voltage regulator includes a differential amplifier having a first input node for receiving a reference voltage, a second input node for coupling to a feedback node to receive a feedback signal representing a sample of the regulated output voltage, and an output node for providing a control voltage based on a differential between the reference voltage and the sample of the regulated output voltage. The voltage regulator also includes an output transistor having a gate node coupled to the differential amplifier to receive the control voltage and a drain node coupled to the output terminal and configured to provide a drain current to the output terminal. The output terminal provides a feedback current to the feedback node and a load current to the load device. The integrated circuit also has a current detection circuit coupled to the output terminal. The current detection circuit has a current sampling circuit and a current comparator circuit. The current sampling circuit includes a first current circuit that provides a first current that is proportional to the drain current and a second current circuit that provides a second current that is proportional to the feedback current. The current sampling circuit is configured to provide a third current that is a difference between the first current and the second current, the third current being proportional to the load current. The current comparator circuit is configured to compare the third current with a threshold current, and output a detection signal that indicates whether the third current matches the threshold current, thereby indicating a target load device is detected.

In some embodiments of the above integrated circuit, the current detection circuit also includes a tracking circuit configured to track the drain-to-source voltage across the output transistor and reproduce the regulated output voltage in the current detection circuit. The tracking circuit includes a unity gain amplifier coupled to the output terminal.

In some embodiments, the threshold current is selected to be a characteristic current of a microphone, and the detection signal is configured to indicate that the microphone is connected to the output terminal.

In some embodiments, the current comparator circuit comprises a Schmitt trigger circuit.

According to some embodiments of the present invention, an integrated circuit includes a current detection circuit configured for coupling to an output terminal of a voltage regulator, the output terminal providing a total current that is divided into a load current to a load device and a feedback current for providing a feedback signal to the voltage regulator. The current detection circuit includes a current sampling circuit and a current comparator circuit. The current sampling circuit provides a first current that is proportional to the total current, a second current that is proportional to the feedback current, and a third current that is proportional to the load current. The current comparator circuit is configured to compare the third current with a threshold current, and output a detection signal that indicates whether the third current matches the threshold current, thereby indicating a target load device is detected.

In some embodiments, the integrated circuit also includes a tracking circuit configured to track the drain-to-source voltage across the output transistor and reproduce the regulated output voltage in the current detection circuit. The tracking circuit includes a unity gain amplifier coupled to the output terminal.

In some embodiments, the integrated circuit also includes a first digital-to-analog converter (DAC) for selecting an output voltage of the voltage regulator and a second digital-to-analog converter (DAC) for selecting the threshold current.

According to some embodiments of the present invention, a method for detecting a load current of a voltage regulator is provided. An output terminal of the voltage regulator provides a total current that is divided into a load current to a load device and a feedback current for providing a feedback signal to the voltage regulator. The method includes providing a first current that is proportional to the total current, providing a second current that is proportional to the feedback current, and determining a third current that is proportional to the load current. The method also includes comparing the third current with a threshold current, and outputting a detection signal that indicates whether the third current matches the threshold current, thereby indicating a target load device is detected.

In some embodiments, the method also includes tracking the drain-to-source voltage across the output transistor and reproducing the regulated output voltage in the current detection circuit.

In some embodiments, the method also includes selecting the threshold current to be a characteristic current of a selected microphone, and outputting the detection signal to indicate that the selected microphone is connected to the output terminal.

In some embodiments, determining the third current that is proportional to the load current includes determining a difference between the first current and the second current.

In some embodiments, the method also includes providing a fourth current that is proportional to the total current, providing a fifth current that is proportional to the feedback current, and determining a sixth current that is proportional to the load current. The method also includes comparing the sixth current with a second threshold current, and outputting a second detection signal that indicates whether the sixth current matches the second threshold current, thereby indicating a second target load device is detected. The second threshold current is selected to be a characteristic current of a push button.

The following description, together with the accompanying drawings, provides further information of the nature and advantages of the claimed invention.

DETAILED DESCRIPTION OF THE INVENTION

Figure 1:
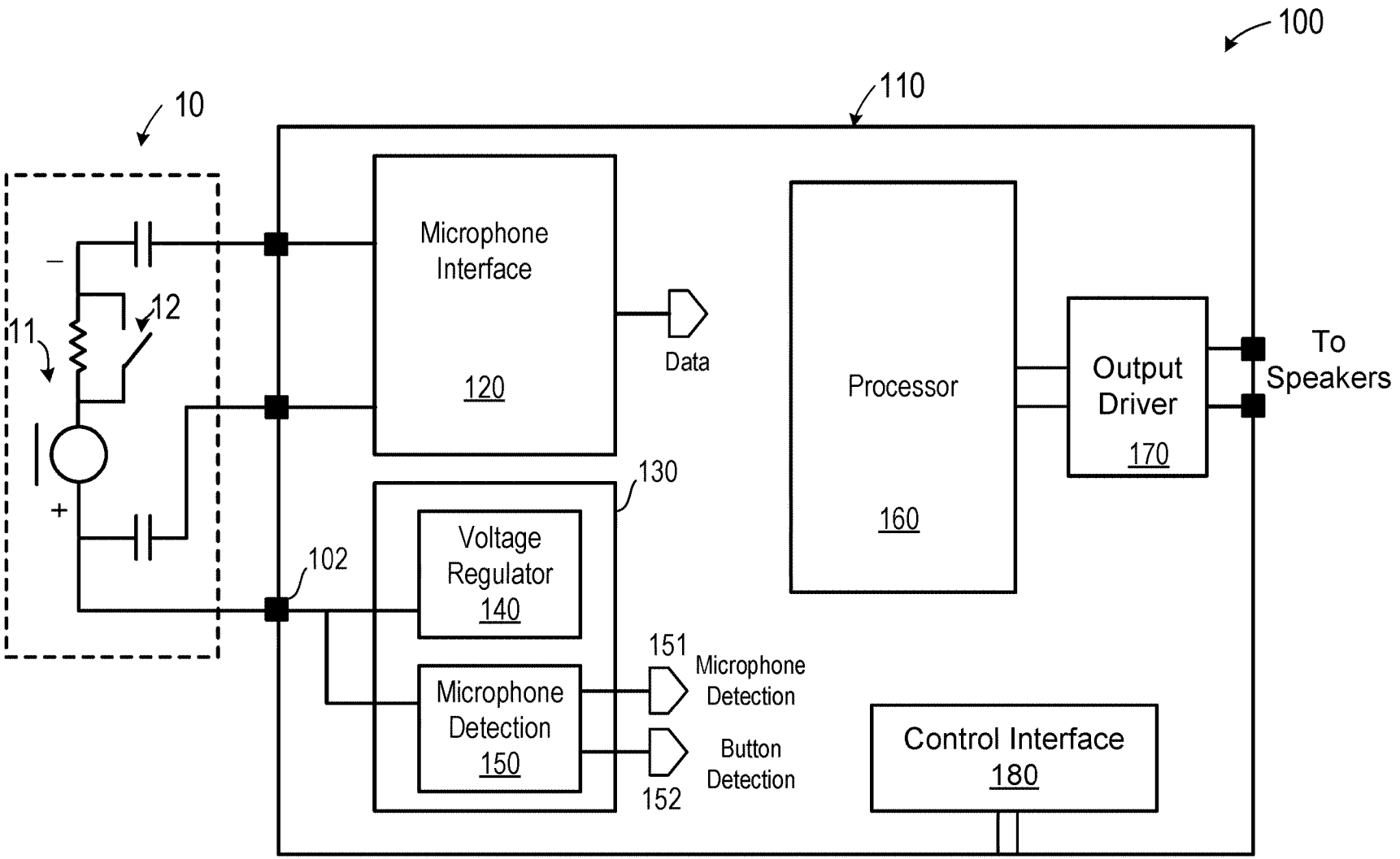
FIG. 1 is a simplified block diagram illustrating an audio system according to some embodiments of the present invention.

FIG. 1 is a simplified block diagram illustrating an audio system according to some embodiments of the present invention. Referring to FIG. 1, the audio system 100 includes an external microphone module 10 and an integrated circuit 110 for receiving audio signals from microphone module 10 and providing output signals to speakers (not shown). Microphone module 10 can include a microphone 11 and a button 12. Microphone 11 can be any suitable microphone and button 12 can be used for turning the microphone on and off. Integrated circuit 110 can include a microphone interface circuit 120, a power supply module 130, and a microphone detection circuit 150. Integrated circuit 110 can also include a processor 160, an output driver 170, and a control interface circuit 180.

Microphone interface circuit 120 is coupled to microphone module 10 to receive audio input signals and provide audio data to processor 160, which provides processed signals to output driver 170 for driving speakers. Control interface circuit 180 can include registers and interfaces to receive control parameters from external sources for controlling programmable features of the integrated circuit 110.

Power supply module 130 can include a voltage regulator 140 and a microphone detection circuit 150. Voltage regulator 140 can be a linear regulator, which provides a regulated voltage at microphone power supply output terminal 102 to supply power to microphone module 10. Microphone detection circuit 150 is coupled to output terminal 102 to provide a microphone detection signal 151 and a button detection signal 152, which can be used by processor 160 in audio signal processing to provide various functions. In some embodiments, the processor can monitor the detection signals by polling an interrupt signal flag.

A description of voltage regulator 140 is provided below in connection with FIG. 2, and a detailed description of microphone detection circuit 150 is provided below in connection with FIGS. 3-5.

Figure 2:
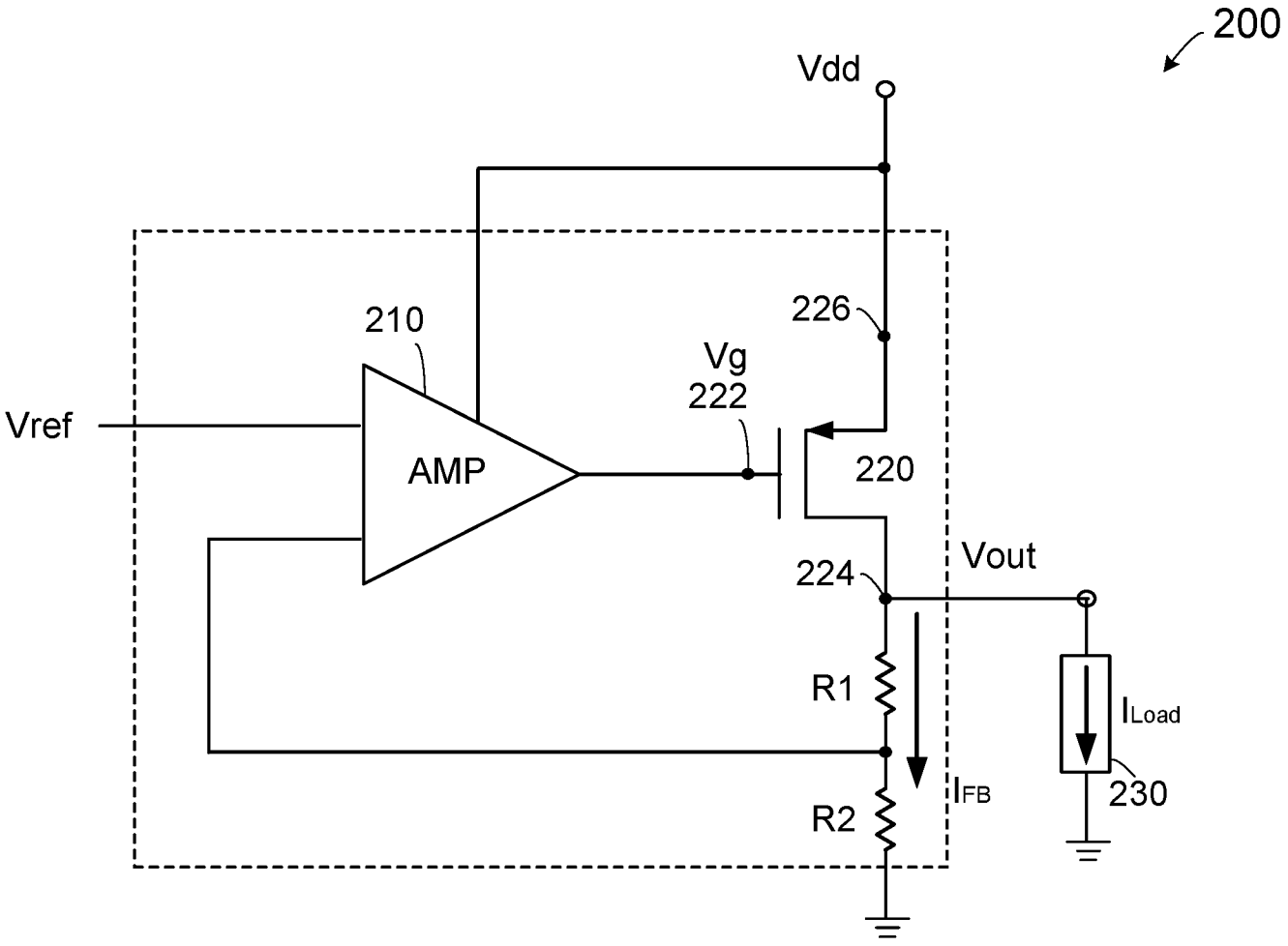
FIG. 2 is a simplified schematic diagram of a voltage regulator for an audio system according to some embodiments of the present invention.

FIG. 2 is a simplified schematic diagram illustrating an example of a voltage regulator for an audio system according to some embodiments of the present invention. The voltage regulator shown in FIG. 2 is an example of a low-dropout voltage regulator (LDO), which is an example of a voltage regulator that can be used as regulator 140 in integrated circuit 110 in FIG. 1. A low-dropout or LDO regulator is a DC linear voltage regulator which can regulate the output voltage. The main components of the LDO regulator can include a differential amplifier and an output transistor. FIG. 2 illustrates a voltage regulator 200 as an example of LDO, in which the differential amplifier 210 can be an error amplifier, and the output transistor 220 can be a power FET (field effect transistor). Differential amplifier 210 is configured to amplify a differential between a reference voltage Vref and a regulated output voltage Vout sampled by a voltage divider formed by resistors R1 and R2. An output of the differential amplifier 210 is coupled to a gate node 222 of output transistor 220. The regulated output voltage Vout is derived at an output node 224 of output transistor 220. The gate voltage at gate node 222 is designated as Vg in FIG. 2. FIG. 2 also shows a power supply Vdd that provides operational power to voltage regulator 200. A load device 230 receives load current $I_{Load}$ provided by voltage regulator 200.

The low-dropout voltage regulator (LDO) illustrated in FIG. 2 is an example of a linear regulator used to maintain a steady voltage. As illustrated in FIG. 2, one input of the differential amplifier 210 monitors the output Vout, and the second input to the differential amplifier 210 receives the control signal, which, in this case, is reference voltage Vref. If the output voltage rises too high or too low relative to the reference voltage, the drive to the power FET changes to maintain a constant output voltage.

Voltage regulator 200 in FIG. 2 has an open drain topology. Output transistor 220 is a P-channel MOS (Metal Oxide Semiconductor) transistor, also designated as a PMOS transistor, with a source node 226 coupled to power supply Vdd, and a drain node 224 serving as an output node, to which a load device is attached. In this topology, the output transistor 220 may be easily driven into saturation with the voltages available to the regulator. This allows the voltage drop from the unregulated voltage Vdd to the regulated voltage Vout to be as low as the saturation voltage across the transistor.

Reference is now made back to FIG. 1. In audio system 100, the information of whether a microphone is connected and what kind of microphone is connected is useful to the integrated circuit to determine what kind of functions can be provided. Therefore, it is desirable for integrated circuit 110 to be able to detect when a microphone module is connected to the power output terminal 102. It is also desirable to be able to determine what kind of microphone module is connected to the microphone. In this device, an extra IO pin is needed, which requires additional chip area. Further, voltage comparators require a very low offset, and since this scheme requires two comparators, the area occupied by the comparators can be a significant overhead to minimize the offset.

In some conventional devices, a separate pin for a microphone may be needed to determine when a microphone is connected to the device. In this method, an external resistor needs to be connected between the microphone power supply terminal on device to bias the microphone and power supply pins. When a microphone is connected, the current flowing through the resistor forces a voltage on the microphone power supply pin. This voltage can then be compared with a reference using a voltage comparator. The reference used in this case is the voltage on microphone power supply pin. In addition, a button detect signal may also be desired. In this device, an extra IO pin is needed, which requires additional chip area. Further, voltage comparators require a very low offset, and since this scheme requires two comparators, the area occupied by the comparators can be a significant overhead to minimize the offset.

In another conventional approach to the detection of microphone connection, a current comparator is used to detect the presence of a microphone by its characteristic current. In this approach, a separate microphone detection pin is not needed. However, when a linear regulator is used to provide the power supply to the microphone, the total current $I_{total}$ provided by the output transistor 220 is the sum of a feedback current $I_{FB}$ and the load current to the microphone LOAD. Therefore, a current comparator connected to the microphone power supply terminal cannot determine the load current accurately.

Accordingly, an improved microphone detection technique is highly desirable.

Embodiments of the present invention provide methods and apparatus with a current tracking system to monitor the load current on the microphone power supply pin and reproduce the same Vds across the current mirrors as the Vds across the output transistor in the voltage regulator. In addition, the load current can be more accurately determined by removing the error caused by the feedback current $I_{FB}$. In embodiments of the invention, an extra microphone detection pin is not required, resulting in saving IO area on the chip. In addition, low-offset voltage comparators are not required, which can also save area.

In some embodiments, the microphone power supply voltage can range from 1.8 V to 3.3 V, and the current supplied to the microphone can range from 50 μA to 5 mA, depending on the type of microphone connected. In other embodiments, other voltage and current ranges can also be used.

A description of voltage regulator 140 is provided below in connection with FIG. 2, and a detailed description of microphone detection circuit 150 is provided below in connection with FIGS. 3-5.

Figure 3:
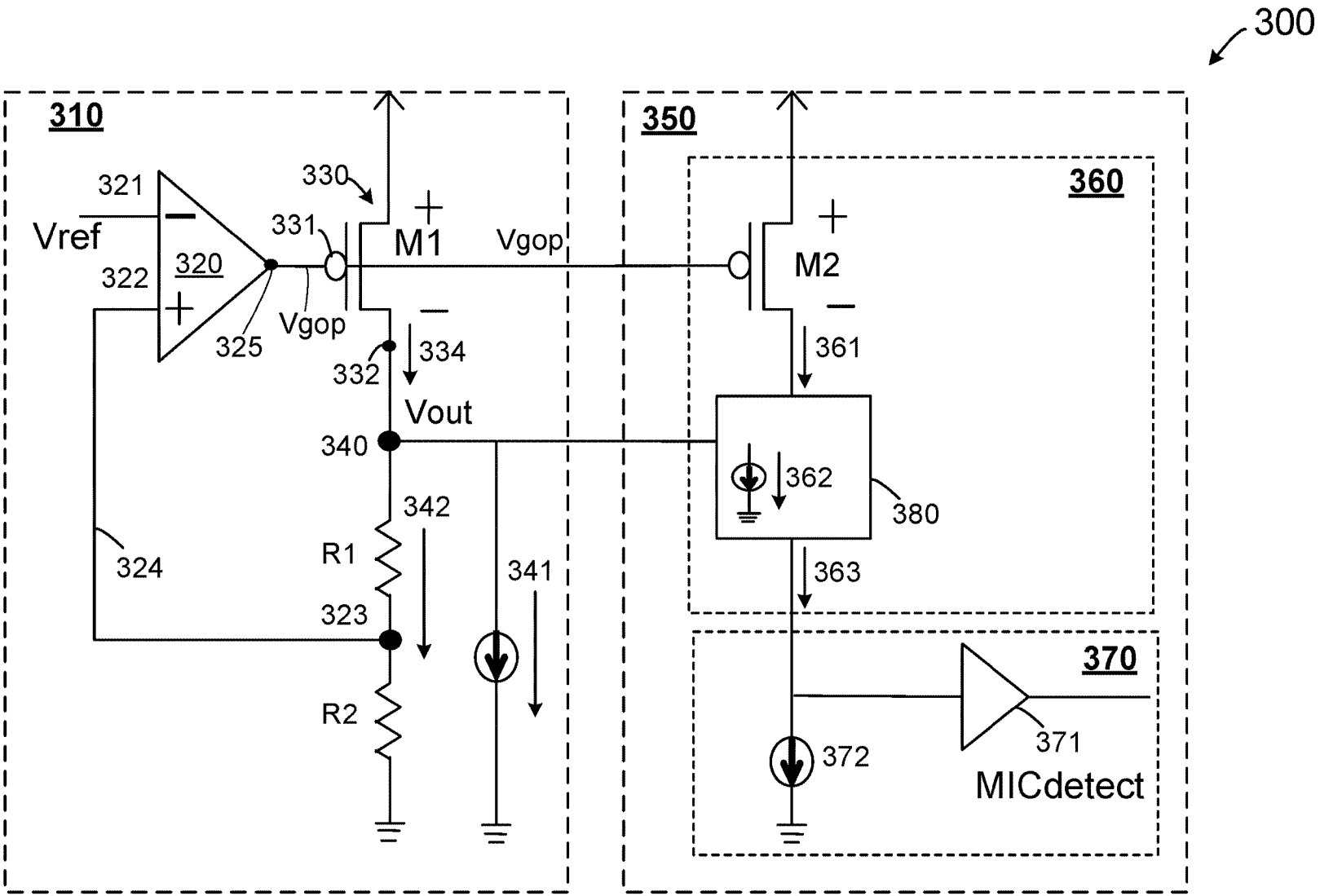
FIG. 3 is a simplified schematic diagram of an integrated circuit for an audio system according to some embodiments of the present invention.

FIG. 3 is a simplified schematic diagram of an integrated circuit for an audio system according to some embodiments of the present invention. FIG. 3 shows an integrated circuit 300 that includes voltage regulator 310 and a current detection circuit 350. Voltage regulator 310 is similar to voltage regulator 200 of FIG. 2. In this example, voltage regulator 310 is a linear regulator including a differential amplifier 320 and output transistor 330 (M1). Voltage regulator 310 is configured to provide a regulated output voltage Vout at an output terminal 340 for coupling to a load device represented by load current 341.

Voltage regulator 310 includes a differential amplifier 320 and an output transistor 330 (M1). Differential amplifier 320 has a first input node 321 for receiving a reference voltage Vref and a second input node 322 for coupling to a feedback node 323, through feedback resistors R1 and R2, to receive a feedback signal 324 representing a sample of the regulated output voltage Vout. Differential amplifier 320 also has an output node 325 for providing a control voltage Vgop based on a differential between the reference voltage Vref and the sample 324 of the regulated output voltage Vout provided by a feedback node 323. Output transistor 330 has a gate node 331 coupled to differential amplifier 320 to receive the control voltage Vgop, and a drain node 332 coupled to the output terminal 340 and configured to provide a drain current 334 to the output terminal 340. The output terminal 340 provides a feedback current 342 to the feedback node 323 and load current 341 to the load device.

Current detection circuit 350 is configured for coupling to output terminal 340 of voltage regulator 310, the output terminal providing a total current 334 that is divided into a load current 341 to a load device and a feedback current 342 for providing a feedback signal 324 in the voltage regulator 310. Current detection circuit 350 includes a current sampling circuit 360 and current comparator circuit 370.

Current sampling circuit 360 includes a first current 361 that is proportional to the total current 334 of the voltage regulator, a second current 362 that is proportional to the feedback current 342, and a third current 363 that is proportional to the load current 342. Current detection circuit 360 further includes a tracking circuit 380 configured to track the drain-to-source voltage Vds across the output transistor 330 of the voltage regulator 310 and reproduce an equal voltage in the current detection circuit 350. In some embodiments, the tracking circuit 380 includes a unity-gain amplifier (not shown in FIG. 3, but described below in connection with FIG. 4) coupled to the output terminal 340 of the voltage regulator 310.

As shown in FIG. 3, current comparator circuit 370 is configured to compare the third current 363 with a threshold current 372, and output a detection signal 374 that indicates whether the third current 363 matches the threshold current 371. Current comparator circuit 370 can include a current comparator 370. The threshold current 372 can be chosen to be a characteristic current of a target load device. In this case, the detection signal 374 can indicate a target load device is detected. As described above, in an audio system, various microphones may consume different load currents. By selecting appropriate threshold currents, different microphones can be identified when they are connected to the voltage regulator. Therefore, current comparator circuit 370 in FIG. 3 is also labeled MICdetect.

Figure 4:
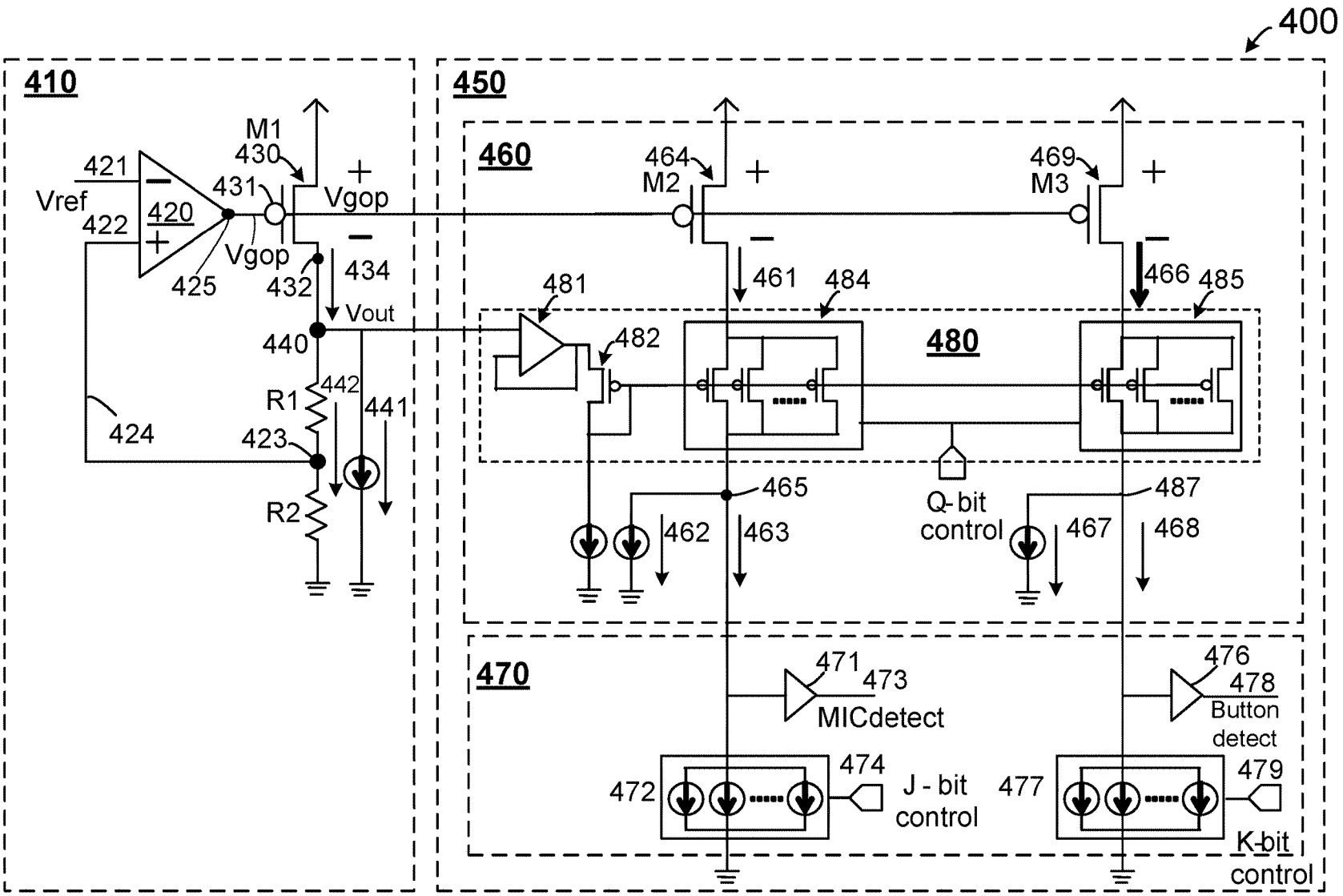
FIG. 4 is a schematic diagram of an integrated circuit for an audio system according to some embodiments of the present invention.

FIG. 4 is a schematic diagram of an integrated circuit for an audio system according to some embodiments of the present invention. FIG. 4 shows an integrated circuit 400 that includes voltage regulator 410 and a current detection circuit 450. Voltage regulator 410 is similar to voltage regulator 310 of FIG. 3 voltage regulator 200 of FIG. 2. In this example, voltage regulator 410 is a linear regulator including a differential amplifier 420 and output transistor 430 (M1). Voltage regulator 410 is configured to provide a regulated output voltage Vout at an output terminal 440 for coupling to a load device represented by load current 441.

Voltage regulator 410 includes a differential amplifier 420 and an output transistor 430 (M1). Differential amplifier 420 has a first input node 421 for receiving a reference voltage Vref and a second input node 422 for coupling to a feedback node 423 to receive a feedback signal 424, through feedback resistors R1 and R2, representing a sample of the regulated output voltage Vout. Differential amplifier 420 also has an output node 425 for providing a control voltage Vgop based on a differential between the reference voltage Vref and the sample 424 of the regulated output voltage Vout provided by a feedback node 423. Output transistor 430 has a gate node 431 coupled to differential amplifier 420 to receive the control voltage Vgop, and a drain node 432 coupled to the output terminal 440 and configured to provide a drain current 434 to the output terminal 440. The output terminal 440 provides a feedback current 442 to the feedback node 423 and load current 441 to the load device.

Current detection circuit 450 is configured for coupling to output terminal 440 of voltage regulator 410, the output terminal providing a total current 434 that is divided into a load current 441 to a load device and a feedback current 442 for providing a feedback signal 424 in the voltage regulator 410. Current detection circuit 450 includes a current sampling circuit 460 and current comparator circuit 470.

Current sampling circuit 460 includes a first current 461 that is proportional to the total current 434 of the voltage regulator, a second current 462 that is proportional to the feedback current 442, and a third current 463 that is proportional to the load current 441. The first current 461 can be provided by a first current circuit that includes a transistor 464 (M2) that forms a current mirror with the output transistor 430 of voltage regulator 410, in which the gate nodes of the two transistors are tied together. As a result, current 461 flowing out of the drain node of transistor 464 mirrors current 434 out of the drain node 432 of output transistor 430. Depending on the ratio between the width/length ratios of the transistor, current 461 can be made to be proportional to current 434 for example, (current 461)=(1/M)*(current 434), where M is an integer. The second current 462 can be provided by a second current circuit having a node 465 that tracks the drain voltage at the drain node 432 of output transistor, and a resistor having a resistance of (R1+R2)/M. Thus, a current 462 is produced that is proportional to the feedback current, i.e., (current 462)=(1/M)*(feedback current 442). It can be seen that the third current 463 is a difference between the first current 461 and the second current 463. Therefore, the third current 463 is proportional to the load current 441, where (load current 441)=(total current 434)−(feedback current 442), and, therefore, (current 463)=(1/M)*(load current 441).

Current detection circuit 460 further includes a tracking circuit 480 configured to track the drain-to-source voltage Vds across the output transistor 430 of the voltage regulator 410 and reproduce a voltage at the node 465 that tracks the voltage at the output terminal 440 of voltage regulator 410, which is also the drain voltage at the drain node 432 of output transistor 430. In some embodiments, tracking circuit 480 includes a unity-gain amplifier 481, coupled to the output terminal 440 of the voltage regulator 410, and a diode-connected transistor 482. A transistor circuit 484 is coupled between transistor 464 and node 465. The gate node of transistor circuit 484 is tied to the gate node of transistor 482 to force the same Vds voltage to appear across transistors 430 and 464. Unity-gain amplifier 481 forces the source node of transistor 482 to be the same as output voltage Vout at output terminal 440 of voltage regulator 410. According to diode-connected transistor 482 and transistor circuits 484, the Vgs will be the same by current mirror. So that the source node of transistor circuits 484 are also clamped at the output voltage Vout at output terminal 440. Thus, the output transistor 430 and transistor 464 have the same Vds. Another function of unity-gain amplifier 481 is to provide isolation for current detection circuit 450 from voltage regulator 410.

In some embodiments, such as the embodiment shown in FIG. 4, the current sampling current 460 in the current detection circuit 450 includes a fourth current 466 that is proportional to the total current 434 of the voltage regulator, a fifth current 467 that is proportional to the feedback current 442, and a sixth current 468 that is proportional to the load current 441. The fourth current 466 can be provided by a third current circuit that includes a transistor 469 (M3) that forms a current mirror with the output transistor 430 of voltage regulator 410, with the gate nodes of the two transistors tied together. As a result, current 466 flowing out of the drain node of transistor 469 mirrors current 434 out of the drain node 432 of output transistor 430. Depending on the ratio between the width/length ratios of the transistor, current 461 can be made to be proportional to current 434 for example, (current 466)=(1/N)*(current 434, where N is an integer. The fifth current 467 can be provided by a fourth current circuit having a node 487 that tracks the drain voltage at the drain node 432 of output transistor, and a resistor having a resistance of (R1+R2)/N. Thus, producing a current 467 that is proportional to the feedback current, i.e., (current 467)=(1/N)*(feedback current 442). It can be seen that the sixth current 468 is the difference between the fourth current 466 and the fifth current 467. Therefore, the sixth current 468 is proportional to the load current 441, where (load current 441)=(total current 434)−(feedback current 442), and, therefore, (current 468)=(1/N)*(load current 441).

In the embodiment of FIG. 4, current comparator circuit 470 can include a first comparator 471 configured to compare the third current 463 with a first threshold current 472, and output a detection signal 473 that indicates whether the third current 463 matches the first threshold current 472. The first threshold current 472 can be chosen to be a characteristic current of a target microphone device, and the detection signal 473 can indicate a target microphone device is detected. As an example, current comparator 471 can be a Schmitt trigger circuit, summing the input current 463 with an output current 472 set by J-bit control.

Current comparator circuit 470 can also include a second current comparator 476 configured to compare the sixth current 468 with a second threshold current 477, and output a detection signal 478 that indicates whether the sixth current 468 matches the second threshold current 475. The second threshold current 477 can be chosen to be a characteristic current of a target load device, and the detection signal 479 can indicate that the load device is detected. Current comparator 476 can also be a Schmitt trigger circuit. As described above in connection to FIG. 1, in an audio system, a control button can be included for turning on or off a microphone. By selecting an appropriate threshold current, the button can be identified when it is connected to output terminal of the voltage regulator. Therefore, detection signal 478 in FIG. 4 is also labeled Button detect.

As described above, in some embodiments, tracking circuit 480 includes a unity-gain amplifier 481, coupled to the output terminal 440 of the voltage regulator 410, and a diode-connected transistor 482. A transistor circuit 484 is coupled between transistor 484 and node 465. In some embodiments, a second transistor circuit 485 is coupled between transistor 469 and node 487. The gate node of transistor circuit 485 is tied to the gate node of transistor 482 to force the same Vds voltage to appear across transistors 430, 464, and 469.

Some embodiments also provide programmable functions to the current detection circuits described above. In current detection circuit 450, transistor circuit 484, functioning as a digital-to-analog converter (DAC), can be implemented using multiple transistors coupled in parallel, and each of the multiple transistors can be selected by a Q-bit digital signal "Q-bit control," where Q is an integer. Similarly, transistor circuit 485 can be implemented using multiple transistors coupled in parallel, and each of the multiple transistors can be selected by the Q-bit digital signal "Q-bit control." Further, the first threshold current 472 can be implemented using multiple current sources coupled in parallel, and each of the multiple current sources can be implemented with a transistor and selected by a J-bit digital signal "J-bit control," where J is an integer. Moreover, the second threshold current 477 can be implemented using multiple current sources coupled in parallel, and each of the multiple current sources can be selected by a K-bit digital signal 479, also labeled "K-bit control," where K is an integer. The control signals for "Q-bit control," "J-bit control," and "K-bit control" can be provided externally through the control interface circuit 180 to provide programmability for the integrated circuit.

Figure 5:
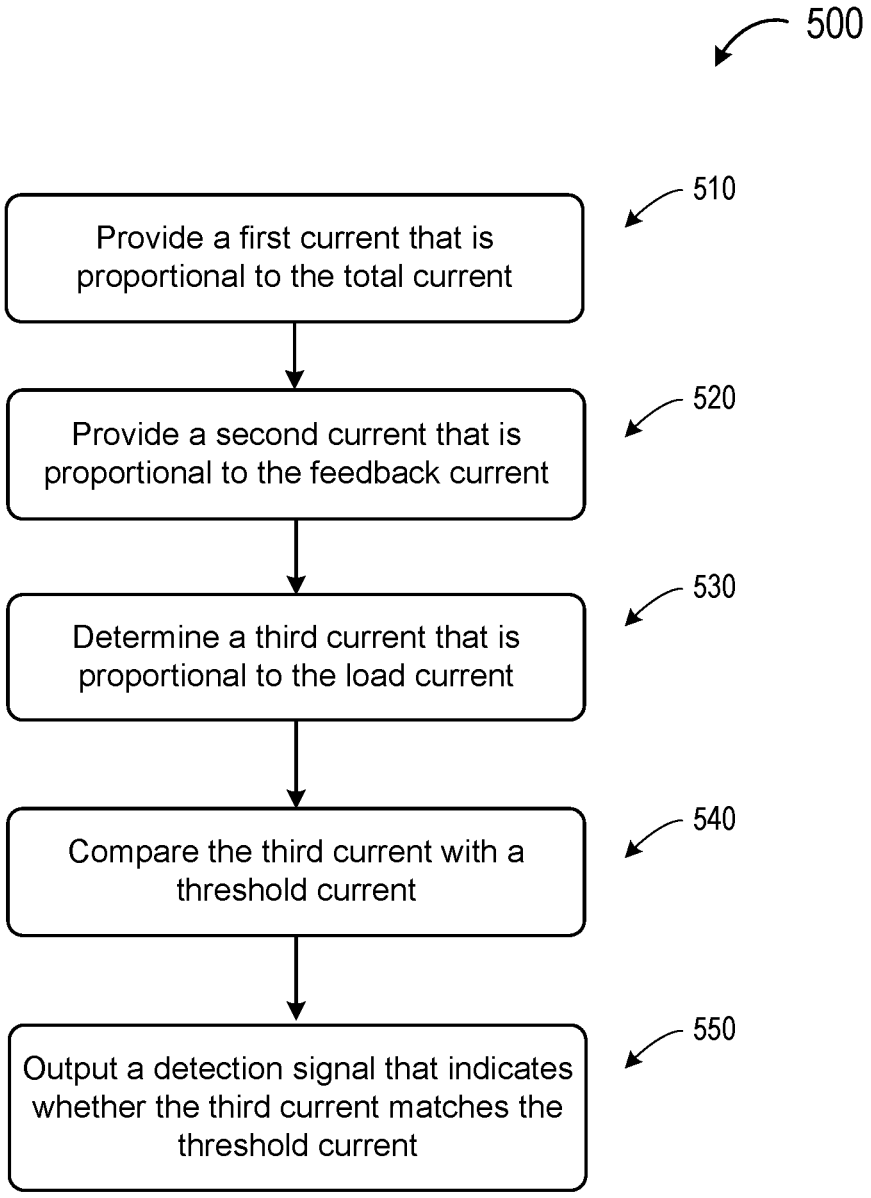
FIG. 5 is a simplified flowchart illustrating some embodiments of the present invention.

FIG. 5 is a simplified flowchart illustrating a method for detecting a load current of a voltage regulator according to some embodiments of the present invention. As shown in FIG. 5, method 500 illustrates a method for detecting a load current of a voltage regulator. An output terminal of the voltage regulator provides a total current that is divided into a load current to a load device and a feedback current for providing a feedback signal to the voltage regulator. The method 500 can be outlined as follows:

510. Provide a first current that is proportional to the total current;

520. Provide a second current that is proportional to the feedback current;

530. Determine a third current that is proportional to the load current;

540. Compare the third current with a threshold current; and

550. Output a detection signal that indicates whether the third current matches the threshold current, thereby indicating a target load device is detected.

At 510, a first current is provided that is proportional to the total current. An example is illustrated in FIG. 4. The first current 461 can be provided by a first current circuit that includes a transistor 464 that forms a current mirror with the output transistor 430 of voltage regulator 410, in which the gate nodes of the two transistors are tied together. As a result, current 461 flowing out of the drain node of transistor 464 mirrors current 434 out of the drain node 432 of output transistor 430. Current 461 can be made to be proportional to current 432, for example, (current 461)=(1/M)*(total current 432), where M is an integer.

At 520, a second current is provided that is proportional to the feedback current. As described above in connection with FIG. 4, the second current 462 can be provided by a second current circuit having a node 465 that tracks the drain voltage at the drain node 432 of output transistor, and a resistor having a resistance of (R1+R2)/M. Thus, a current 462 is produced that is proportional to the feedback current, i.e., (current 462)=(1/M)*(feedback current 442).

At 530, a third current is determined that is proportional to the load current. As shown in FIG. 4, the third current 463 is a difference between the first current 461 and the second current 463. Therefore, the third current 463 is proportional to the load current 441, where (load current 441)=(total current 434)−(feedback current 442), and, therefore, (current 463)=(1/M)*(load current 441).

At 540, the third current is compared with a threshold current. As shown in FIG. 4, the first comparator 471 can be used to compare the third current 463 with a first threshold current 472 to determine if the third current 463 matches first threshold current 472.

At 550, the first comparator 471 outputs a detection signal 473 that indicates whether the third current 463 matches the first threshold current 472. In some embodiments, the first threshold current 472 can be chosen to be a characteristic current of a target microphone device, and the detection signal 473 can indicate a target microphone device is detected.

In some embodiments, the method also includes tracking the drain-to-source voltage across the output transistor and reproducing the regulated output voltage in the current detection circuit.

In some embodiments, the method also includes selecting the threshold current to be a characteristic current of a selected microphone, and outputting the detection signal to indicate that the selected microphone is connected to the output terminal.

In some embodiments, determining the third current that is proportional to the load current includes determining a difference between the first current and the second current.

In some embodiments, the method also includes providing a fourth current that is proportional to the total current, providing a fifth current that is proportional to the feedback current, and determining a sixth current that is proportional to the load current. The method also includes comparing the sixth current with a second threshold current, and outputting a second detection signal that indicates whether the sixth current matches the second threshold current, thereby indicating a second target load device is detected. The second threshold current is selected to be a characteristic current of a push button.

It is understood that the examples and embodiments described herein are for illustrative purposes only and that various modifications or changes in light thereof will be suggested to persons skilled in the art and are to be included within the spirit and purview of this application and scope of the appended claims.

What is claimed is:

1. An integrated circuit for audio microphone detection, comprising:

a voltage regulator configured to provide a regulated output voltage at an output terminal for coupling to a load device, the voltage regulator including:

a differential amplifier, including:

a first input node for receiving a reference voltage;

a second input node for coupling to a feedback node to receive a feedback signal representing a sample of the regulated output voltage; and an output node for providing a control voltage based on a differential between the reference voltage and the sample of the regulated output voltage; and an output transistor, including:

a gate node coupled to the differential amplifier to receive the control voltage; and a drain node coupled to the output terminal and configured to provide a drain current to the output terminal;

wherein the output terminal provides a feedback current to the feedback node and a load current to the load device; and a current detection circuit coupled to the output terminal, the current detection circuit including:

a current sampling circuit, including:

a first current circuit that provides a first current that is proportional to the drain current; and a second current circuit that provides a second current that is proportional to the feedback current;

wherein the current sampling circuit is configured to provide a third current that is a difference between the first current and the second current, the third current being proportional to the load current; and a current comparator circuit configured to:

compare the third current with a threshold current; and output a detection signal that indicates whether the third current matches the threshold current, thereby indicating a target load device is detected.

2. The integrated circuit of claim 1, wherein the current detection circuit further comprises a tracking circuit configured to track a drain-to-source voltage across the output transistor and reproduce the regulated output voltage in the current detection circuit, the tracking circuit comprising a unity-gain amplifier coupled to the output terminal.

3. The integrated circuit of claim 1, wherein the threshold current is selected to be a characteristic current of a microphone; and the detection signal is configured to indicate that the microphone is connected to the output terminal.

4. The integrated circuit of claim 1, wherein the current comparator circuit comprises a Schmitt trigger circuit.

5. The integrated circuit of claim 1, wherein, in the current detection circuit, the current sampling circuit is configured to provide:

a fourth current that is proportional to the drain current;

a fifth current that is proportional to the feedback current; and a sixth current that is proportional to the load current; and the current comparator circuit is configured to:

compare the sixth current with a second threshold current; and output a second detection signal to indicate whether the sixth current matches the second threshold current;

wherein:

the second threshold current is selected to be a characteristic current of a push button; and the second detection signal is configured to indicate that the push button is connected to the output terminal.

6. An integrated circuit, comprising:

a current detection circuit configured for coupling to an output terminal of a voltage regulator, the output terminal providing a total current that is divided into a load current to a load device and a feedback current for providing a feedback signal to the voltage regulator, the current detection circuit, comprising:

a current sampling circuit, providing:

a first current that is proportional to the total current;

a second current that is proportional to the feedback current; and a third current that is proportional to the load current; and a current comparator circuit configured to:

compare the third current with a threshold current; and output a detection signal that indicates whether the third current matches the threshold current, thereby indicating a target load device is detected.

7. The integrated circuit of claim 6, further comprising a tracking circuit configured to track a drain-to-source voltage across an output transistor and reproduce a regulated output voltage in the current detection circuit, the tracking circuit comprising a unity-gain amplifier coupled to the output terminal.

8. The integrated circuit of claim 6, wherein the threshold current is selected to be a characteristic current of a selected microphone; and the detection signal is configured to indicate that the selected microphone is connected to the output terminal.

9. The integrated circuit of claim 6, wherein the current sampling circuit comprises:

a first current circuit that provides the first current that is proportional to the total current; and a second current circuit that provides the second current that is proportional to the feedback current;

wherein the current sampling circuit is configured to provide the third current that is a difference between the first current and the second current, the third current being proportional to the load current.

10. The integrated circuit of claim 6, wherein the voltage regulator comprises a linear regulator.

11. The integrated circuit of claim 10, wherein the linear regulator comprises: a differential amplifier which comprises: a first input node for receiving a reference voltage; a second input node for coupling to a feedback node to receive the feedback signal representing a sample of an output voltage of the linear regulator; and an output node for providing a control voltage based on a differential between the reference voltage and the sample of the output voltage; and an output transistor which comprises: a gate node coupled to the differential amplifier to receive the control voltage; and a drain node coupled to the output terminal and providing a drain current to the output terminal; wherein the output terminal provides the feedback current to the feedback node and the load current to the load device.

12. The integrated circuit of claim 6, wherein the current comparator circuit comprises a Schmitt trigger circuit.

13. The integrated circuit of claim 6, wherein, in the current detection circuit, the current sampling circuit is configured to provide:

a fourth current that is proportional to a drain current;

a fifth current that is proportional to the feedback current; and a sixth current that is proportional to the load current; and the current comparator circuit is configured to:

compare the sixth current with a second threshold current; and output a second detection signal to indicate whether the sixth current matches the second threshold current.

14. The integrated circuit of claim 13, wherein:

the second threshold current is selected to be a characteristic current of a push button; and the second detection signal is configured to indicate that the push button is connected to the output terminal.

15. The integrated circuit of claim 6, further comprising:

a first digital-to-analog converter (DAC) for selecting an output voltage of the voltage regulator; and a second digital-to-analog converter (DAC) for selecting the threshold current.

16. A method for detecting a load current of a voltage regulator, an output terminal of the voltage regulator providing a total current that is divided into a load current to a load device and a feedback current for providing a feedback signal to the voltage regulator, the method comprising:

providing a first current that is proportional to the total current;

providing a second current that is proportional to the feedback current;

determining a third current that is proportional to the load current;

comparing the third current with a threshold current; and outputting a detection signal that indicates whether the third current matches the threshold current, thereby indicating a target load device is detected.

17. The method of claim 16, further comprising tracking a drain-to-source voltage across an output transistor and reproducing a regulated output voltage in a current detection circuit.

18. The method of claim 16, further comprising selecting the threshold current to be a characteristic current of a selected microphone; and outputting the detection signal to indicate that the selected microphone is connected to the output terminal.

19. The method of claim 16, wherein determining the third current that is proportional to the load current comprises determining a difference between the first current and the second current.

20. The method of claim 16, further comprising:

sensing a fourth current that is proportional to the total current;

sensing a fifth current that is proportional to the feedback current;

determining a sixth current that is proportional to the load current;

comparing the sixth current with a second threshold current; and outputting a second detection signal that indicates whether the sixth current matches the second threshold current, thereby indicating a second target load device is detected;

wherein the second threshold current is selected to be a characteristic current of a push button.

* * * * *